US006237151B1

(12) United States Patent
Dellinger

(10) Patent No.: US 6,237,151 B1
(45) Date of Patent: May 29, 2001

(54) WARM-UP GARMENT WITH TORSO WRAP

(76) Inventor: Thomas Edwin Dellinger, 1663 Village Ct., Gastonia, NC (US) 28054

( * ) Notice: Subject to any disclaimer, the term of this patent is extended or adjusted under 35 U.S.C. 154(b) by 0 days.

(21) Appl. No.: 09/676,231

(22) Filed: Sep. 29, 2000

(51) Int. Cl.[7] ..... A41D 27/12
(52) U.S. Cl. ..... 2/69; 2/59
(58) Field of Search ..... 2/44, 45, 46, 16, 2/51, 59, 69, 91, 92, 102

(56) References Cited

U.S. PATENT DOCUMENTS

| | | | | |
|---|---|---|---|---|
| 1,424,215 | * | 8/1922 | Rowe | 2/59 |
| 1,796,782 | * | 3/1931 | Gasperini | 2/59 |
| 1,833,109 | * | 11/1931 | Day | 2/16 |
| 4,356,570 | * | 11/1982 | Vernon et al. | 2/16 |
| 4,985,934 | * | 1/1991 | Perry | 2/125 |
| 5,638,546 | * | 6/1997 | Vita | 2/16 |
| 5,909,801 | * | 6/1999 | Coffman | 2/16 |

* cited by examiner

*Primary Examiner*—Gloria M. Hale
(74) *Attorney, Agent, or Firm*—Adams, Schwartz & Evans, P.A.

(57) ABSTRACT

A warm-up garment for maintaining warmth in a single arm and shoulder area of a wearer, comprising a single sleeve having an upper end with an opening for receiving the wearer's hand and arm therethrough, and a lower end having a lower opening for receiving the wearer's hand therethrough. A body portion is attached to the sleeve adjacent the upper end opening and includes front and back panels joined across a top and a side edge adjacent the sleeve and extending diagonally across the torso of the wearer from the upper end of the sleeve to an area under the wearer's arm opposite the sleeve. The warm-up garment also includes an attachment panel having a first end attached to the back panel and a second end adapted for being extended from the back panel around the area under the wearer's arm opposite the sleeve to the front panel and for releasably securing the front and back panels around the body of the wearer without encircling the neck of the wearer.

9 Claims, 8 Drawing Sheets

WARM-UP GARMENT WITH TORSO WRAP

TECHNICAL FIELD AND BACKGROUND OF THE INVENTION

This invention relates to a warmup garment used to maintain warmth in a single arm and shoulder of an athlete. During many typical athletic events such as baseball or football games, a participating athlete does not engage in continuous play, but instead enters and exits the game intermittently, participating only for short periods of time. Without proper warmup, a short burst of anaerobic activity—even if followed by a brief period of aerobic activity—can not only severely strain, but also seriously injure, the particular muscle groups and associated connective tissue being used by the athlete during the event.

While the problem of achieving and maintaining proper muscular warmup affects all types of athletes, baseball players face unique challenges. Much of a baseball player's success depends upon how well his pitching or throwing arm performs. Because a baseball player does not engage in continuous play throughout a game, retaining warmth, flexibility and limberness in the arm and shoulder area is particularly difficult. Furthermore, because baseball players enter and exit the game so quickly during and between innings, the arm and shoulder areas often do not adequately cool down after use, which exacerbates the risk of injury to muscle groups and connective tissue which may already be inflamed or damaged.

Prior attempts to address the specific needs of baseball players have been inadequate, in that prior art warmup devices typically must be secured to the wearer by using straps placed around the wearer's neck. Such straps make removal of the warmup device difficult and time consuming, as the wearer must use both hands to initiate removal. Furthermore, if the wearer needs to quickly remove the device, he must often resort to pulling the entire device over his head, which is disruptive and inconvenient, since it may require first removing a helmet or hat.

The invention of the present application addresses the problem of adequately maintaining warmth and flexibility in an athlete's arm and shoulder by providing a warmup garment having a single sleeve and a body portion which covers the arm, shoulder, and adjacent upper torso region. The garment includes a unique attachment panel that extends beneath the athlete's arm opposite the sleeve of the garment. The attachment panel connects to a front panel just below the athlete's sternum using fasteners that are easy to open and close. Positioning the attachment panel around the upper torso and placing the fasteners on the front panel allows the athlete to release the fasteners using only one hand, and quickly remove the garment without resorting to pulling it over his head. Furthermore, the increased width of the attachment panel enhances the overall comfort of the athlete by eliminating the pulling, pinching and tugging associated with conventional elastic straps commonly used on prior art warmup garments. Optional external and internal pockets positioned in the elbow and shoulder areas of the garment permit the use of therapeutic heating and cooling pads to enhance healing and preserve flexibility of specific muscle groups and connective tissues.

The warmup garment of the present invention uses commonly available materials and components which may be easily and inexpensively manufactured and supplied to the user in many different forms, resulting in a garment that is aesthetically pleasing, effective, and easy to use.

SUMMARY OF THE INVENTION

Therefore, it is an object ofthe invention to provide a warmup garment capable of maintaining warmth and flexibility in a single arm and shoulder of an athlete.

It is another object of the invention to provide a warmup garment that can be quickly and easily put on and removed.

It is another object of the invention to provide a warmup garment which is inexpensive and easy to manufacture from commonly available components.

It is another object of the invention to provide a warmup garment which has a single sleeve and shoulder area and includes pockets adapted for receiving therapeutic heating and cooling packs therein for providing additional warmth or cooling to the areas of the athlete's body adjacent the pockets.

These and other objects of the present invention are achieved in the preferred embodiments disclosed below by providing a warm-up garment for maintaining warmth in a single arm and shoulder area of a wearer, including a single sleeve having an upper end with an opening for receiving the wearer's hand and arm therethrough and a lower end having a lower opening for receiving the wearer's hand therethrough. A body portion is attached to the sleeve adjacent the upper end opening and comprising front and back panels joined across a top and a side edge adjacent the sleeve and extending diagonally across the torso of the wearer from the upper end of the sleeve to an area under the wearer's arm opposite the sleeve. The warm-up garment also includes an attachment panel having a first end attached to the back panel and a second end adapted for being extended from the back panel around the area under the wearer's arm opposite the sleeve to the front panel for releasably securing the front and back panels around the body of the wearer without encircling the neck of the wearer.

According to another preferred embodiment of the invention, the lower end of the sleeve includes a cuff adapted for fitting closely against the wearer's wrist.

According to yet another preferred embodiment of the invention, the front panel includes a first oblique edge extending diagonally from the top edge across the chest of the wearer and a front bottom edge extending across the upper torso adjacent the rib cage of the wearer.

According to yet another preferred embodiment of the invention, the back panel includes a second oblique edge extending from the top edge diagonally across the spinal column of the wearer and a back bottom edge extending between the side edge adjacent the sleeve and the second edge of the attachment panel.

According to yet another preferred embodiment of the invention, the front panel further includes inner and outer faces, the inner face adapted for releasably securing an outer surface of the second end of the attachment panel thereto.

According to yet another preferred embodiment of the invention, the warm-up garment includes complementary fasteners attached to the outer surface of the attachment panel and to the inner face of the front panel for releasably securing the outer surface to the inner face.

According to yet another preferred embodiment of the invention, the complementary fasteners are attached to the outer surface of the second end of the attachment panel and the inner face of the front panel adjacent the front bottom edge.

The complementary fasteners are preferably strips of hook-and-loop material.

According to yet another preferred embodiment of the invention, the warm-up garment further includes at least one pocket attached to the sleeve and adapted for receiving a therapeutic pack therein.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
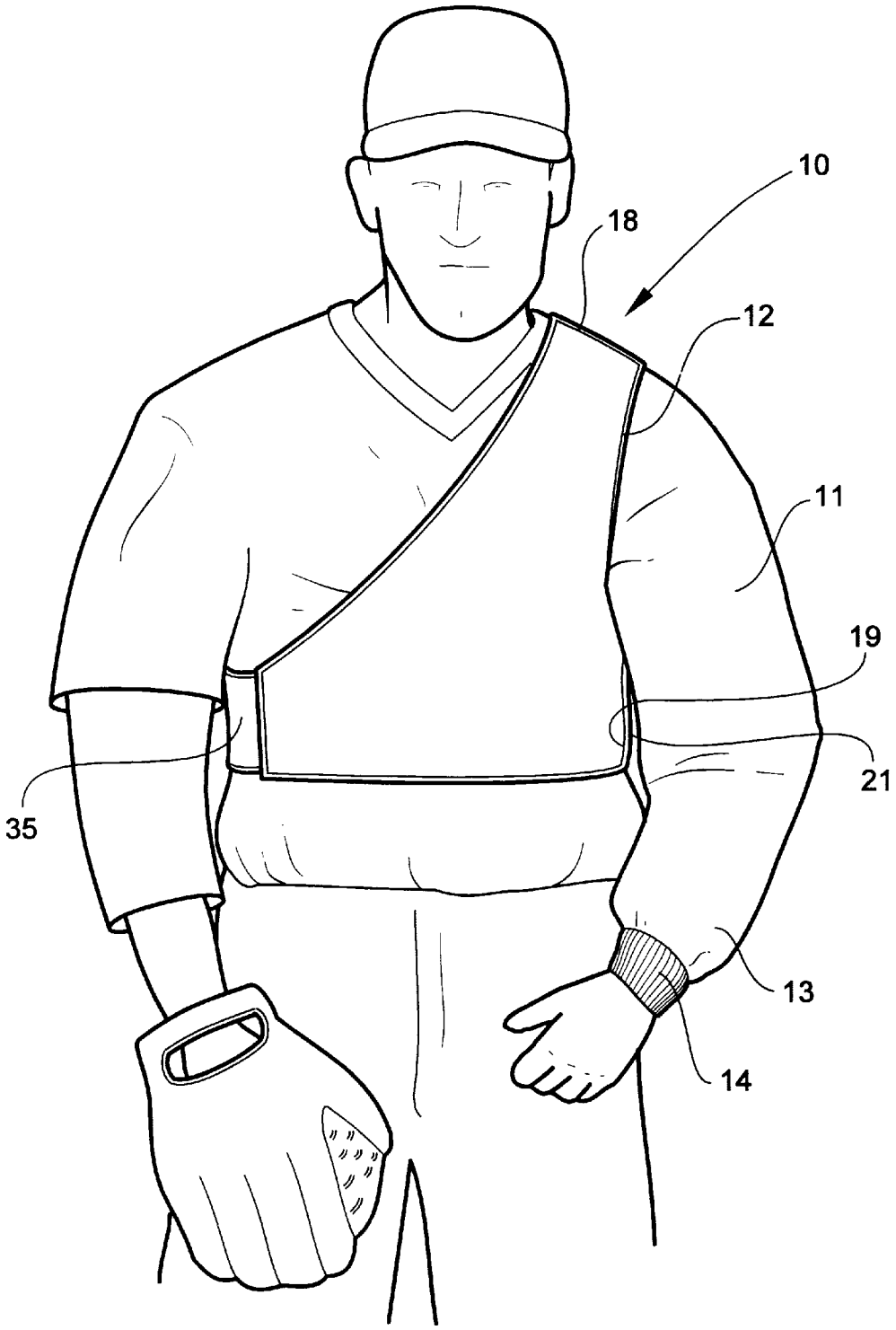
FIG. 1 is an environmental perspective view of a warm-up garment according to the present invention showing the garment positioned on the arm and around the torso of a wearer.

Referring now specifically to the drawings, a warmup garment according to the present invention is illustrated in FIG. 1 and shown generally at reference numeral 10. The garment 10 is shown being worn by a baseball player; however, the garment 10 is also ideal for use by participants in other sports or professions, including but not limited to football, tennis, and golf, as well as construction trades, where therapeutic warming or cooling of the arm and/or shoulder areas may be required. Although the garment 10 is preferably formed from nylon fabric, the garment 10 may alternatively be formed from any suitable flexible, durable fabric material. The garment 10 is shaped to cover the wearer's arm, shoulder, and upper torso, and includes a sleeve 11 having an open upper end 12 through which the wearer's hand and arm are received, and an open lower end 13 through which the wearer's hand is received. A cuff 14 is attached to the lower end 13 for drawing the lower end 13 close to the wearer's wrist, thereby further insulating the wearer's arm and maintaining the temperature inside the sleeve 11.

Figure 2:
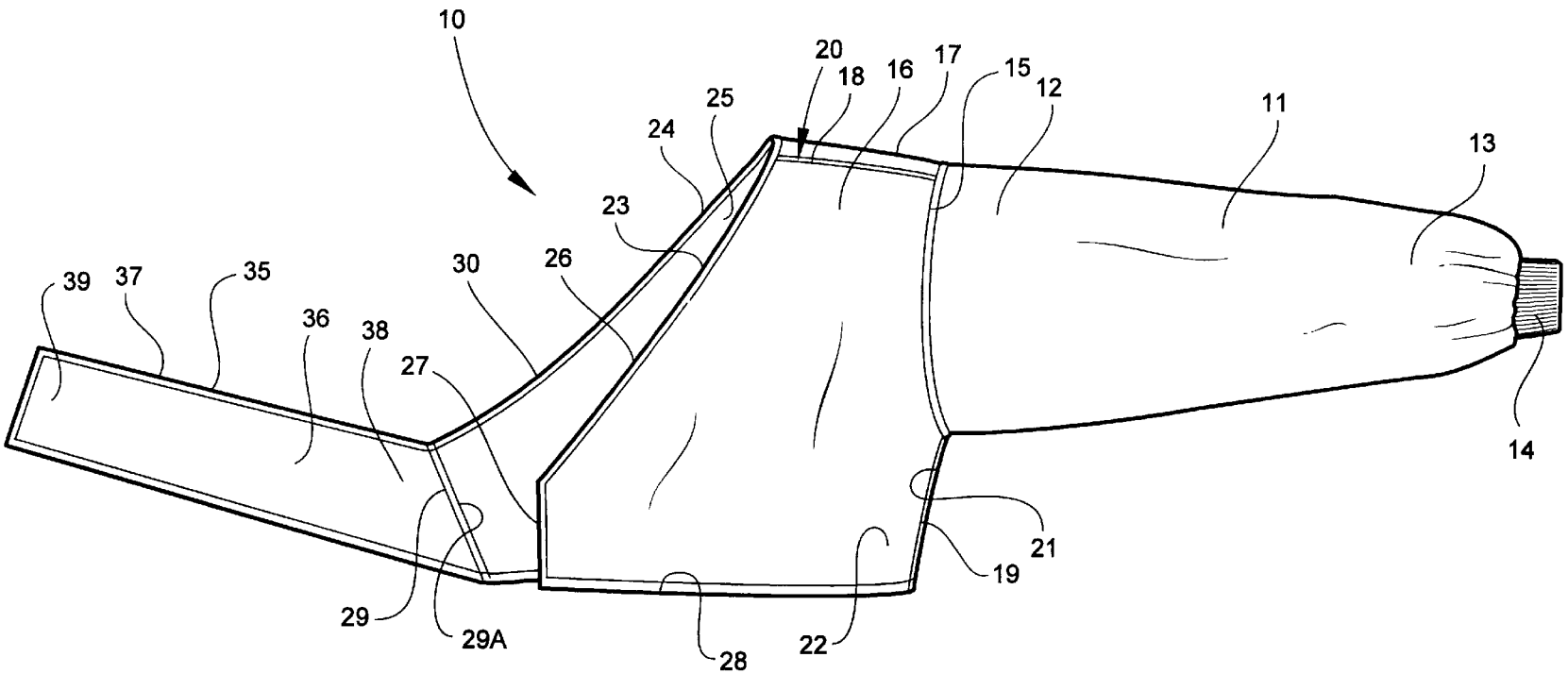
FIG. 2 is a front elevation of a warmup garment according to one embodiment of the present invention with the attachment panel in an open position.

Referring now to FIG. 2, the upper end 12 of the sleeve 11 is attached by a seam 15 to front and back panels 16 and 17, respectively. Front and back panels 16 and 17 are joined together at seams 18 and 19 to form respective top and side edges 20 and 21. Seam 18 extends between the neck and shoulder of a wearer, and seam 19 extends downwardly from the upper end 12 of the sleeve 11 to beneath the wearer's arm. See FIG. 1. The respective interiors of front and back panels 16 and 17 communicate with the interior of the sleeve 11 for receiving and covering the wearer's shoulder and the adjacent upper torso region.

Figure 3:
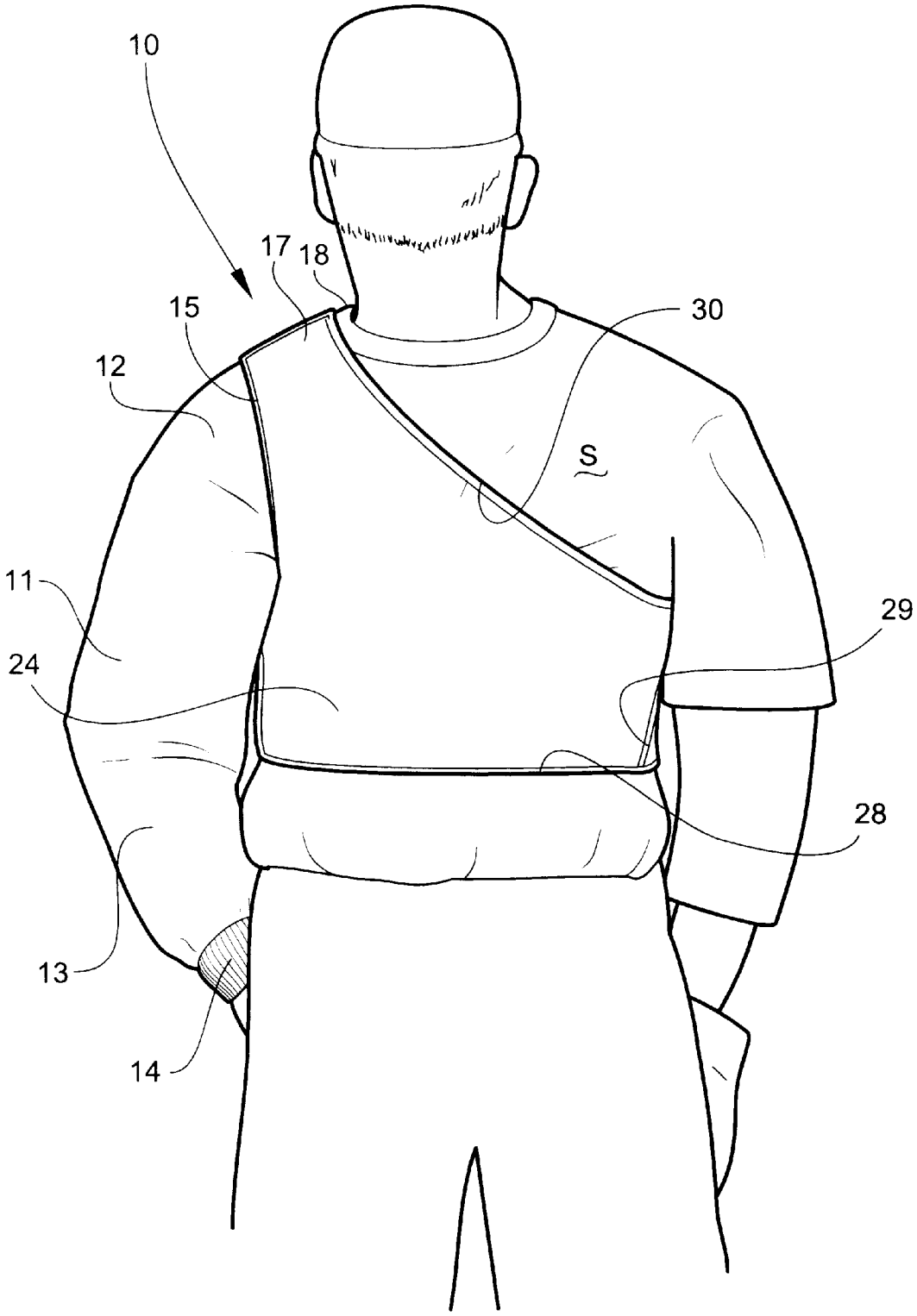
FIG. 3 is an environmental perspective view of the back of the warmup garment shown in FIG. 1.

As shown in FIG. 2, the front panel 16 includes respective front and back faces 22 and 23, and the back panel includes respective first and second faces 24 and 25. The front panel defines a first oblique edge 26 which extends diagonally from the seam 18 to a front attachment edge 27. Front attachment edge 27 terminates at a bottom edge 28 which extends therefrom along the bottom of front and back panels 16 and 17, respectively, to a rear attachment edge 29 defined by the back panel 17. Rear attachment edge 29 can be positioned at any angle with respect to the bottom edge 28; however, the rear attachment edge 29 preferably extends diagonally upward and away from bottom edge 28 to a second oblique edge 30. As shown in FIG. 3, second oblique edge 30 extends diagonally between the seam 18 and rear attachment edge 29, so that the back panel 17 covers not only the wearer's scapula adjacent the sleeve 11, but also a portion of the scapula "S" opposite the sleeve 11.

Referring again to FIG. 2, the garment 10 also includes an elongate attachment panel 35 having respective inner and outer surfaces 36 and 37, and respective proximal and distal ends 38 and 39. The attachment panel 35 connects to the front panel 16 and is for securing the garment 10 around the upper torso of the wearer. Proximal end 38 is attached to the rear attachment edge 29 of the back panel 17 by a seam 29A, thereby positioning the attachment panel 35 so that the distal end 39 extends beneath the wearer's arm opposite side edge 21.

Figure 4:
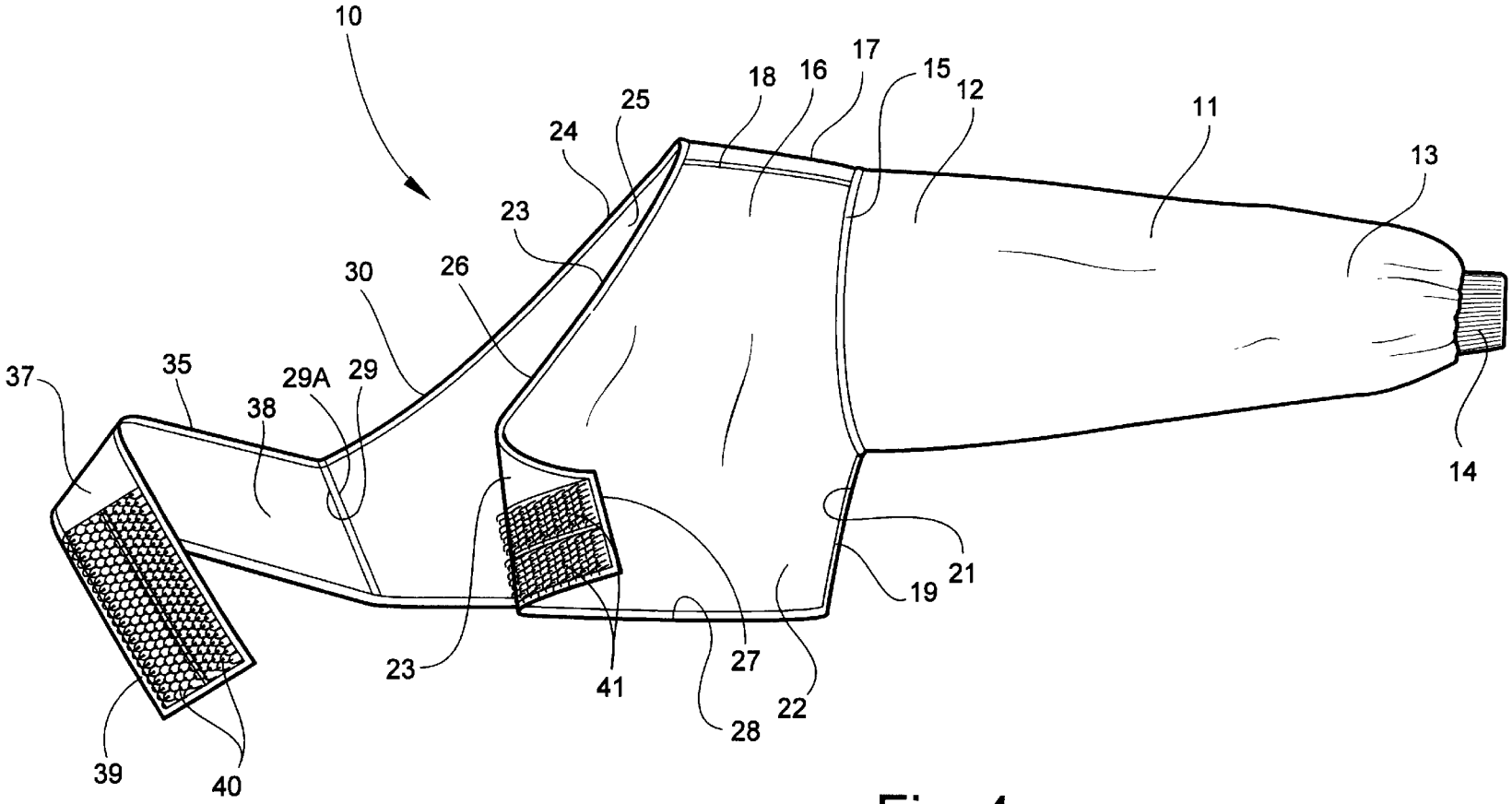
FIG. 4 is a perspective view of the warmup garment shown in FIG. 2.

Referring now to FIG. 4, two strips of male or female hook-and-loop fasteners 40 are attached to the outer surface 37 of distal end 39. Fastener strips 40 cooperate with two complementary strips of male or female hook-and-loop fasteners 41. Fastener strips 41 are attached to the back face 23 of front panel 16 adjacent the bottom edge 28 and front attachment edge 27 for releasably connecting the back face 23 to the outer surface 37 of attachment panel 35 around the wearer's upper torso. Although hook-and-loop fasteners are preferably used to fasten the attachment panel 35 to the front panel 16, complementary snaps, hook-and-eye fasteners, or any other type of suitable closure devices may alternatively be employed.

Figure 5:
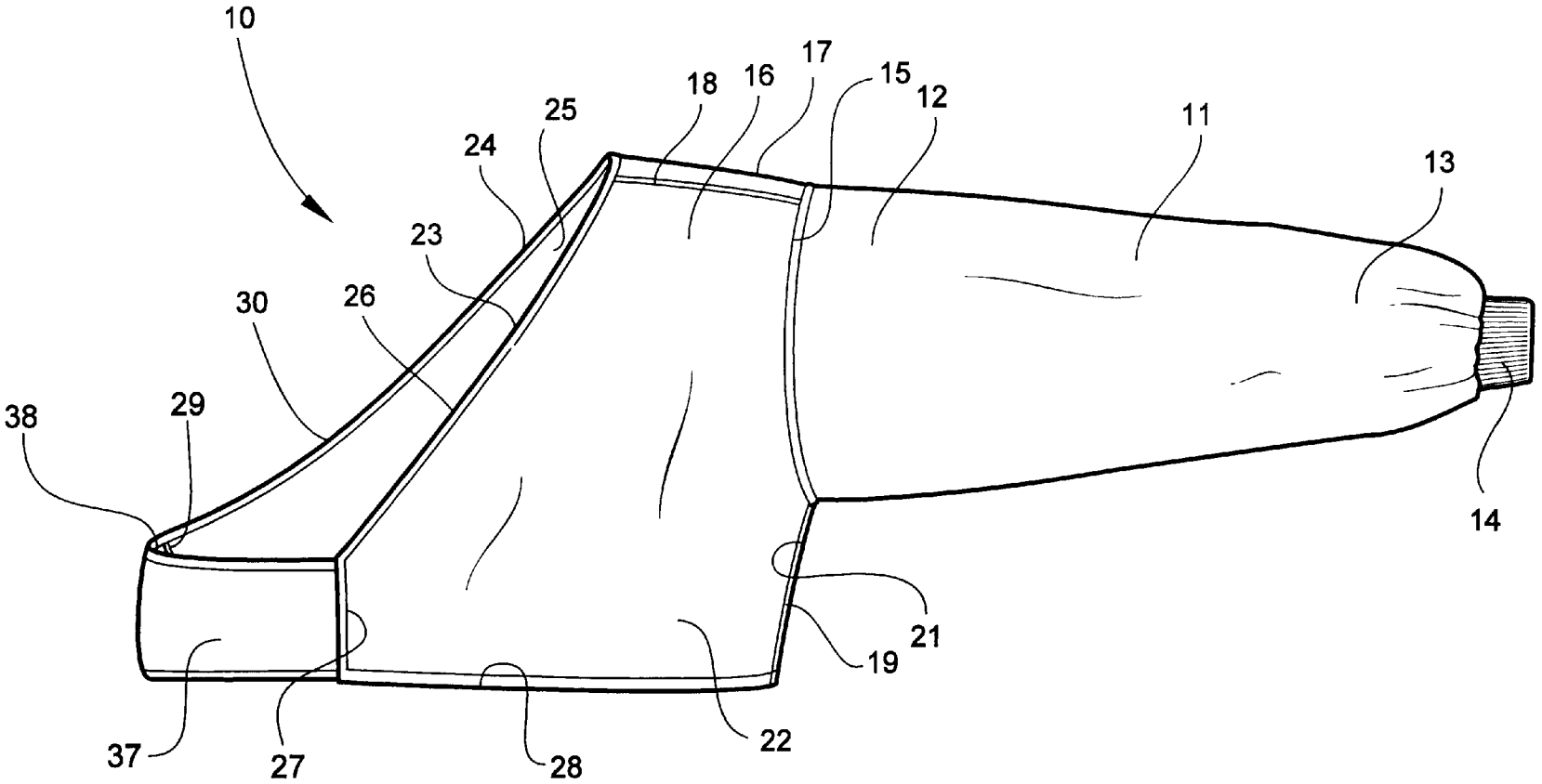
FIG. 5 is a front elevation of the warmup garment shown in FIG. 2 with the attachment panel in a closed position.

Referring now to FIG. 5, the front of the garment 10 is shown in a closed position, with the distal end 39 of the attachment strap 35 attached to the back face 23 of front panel 16.

Attaching the fastener strips 40 and 41 to the outer surface 37 of distal end 39 and the back face 23 of front panel 16, respectively, allows an individual wearing the garment 10 to release the garment 10 from around the torso using a single motion by simply grasping the front attachment edge 27 with the left hand and pulling the front attachment edge 27 toward the side seam 21 to release the fastener strips 41 from the fastener strips 40. Once the fastener strips 40 and 41 are released, the garment 10 is removed by pulling the sleeve 11 off of the wearer's arm.

Figure 6:
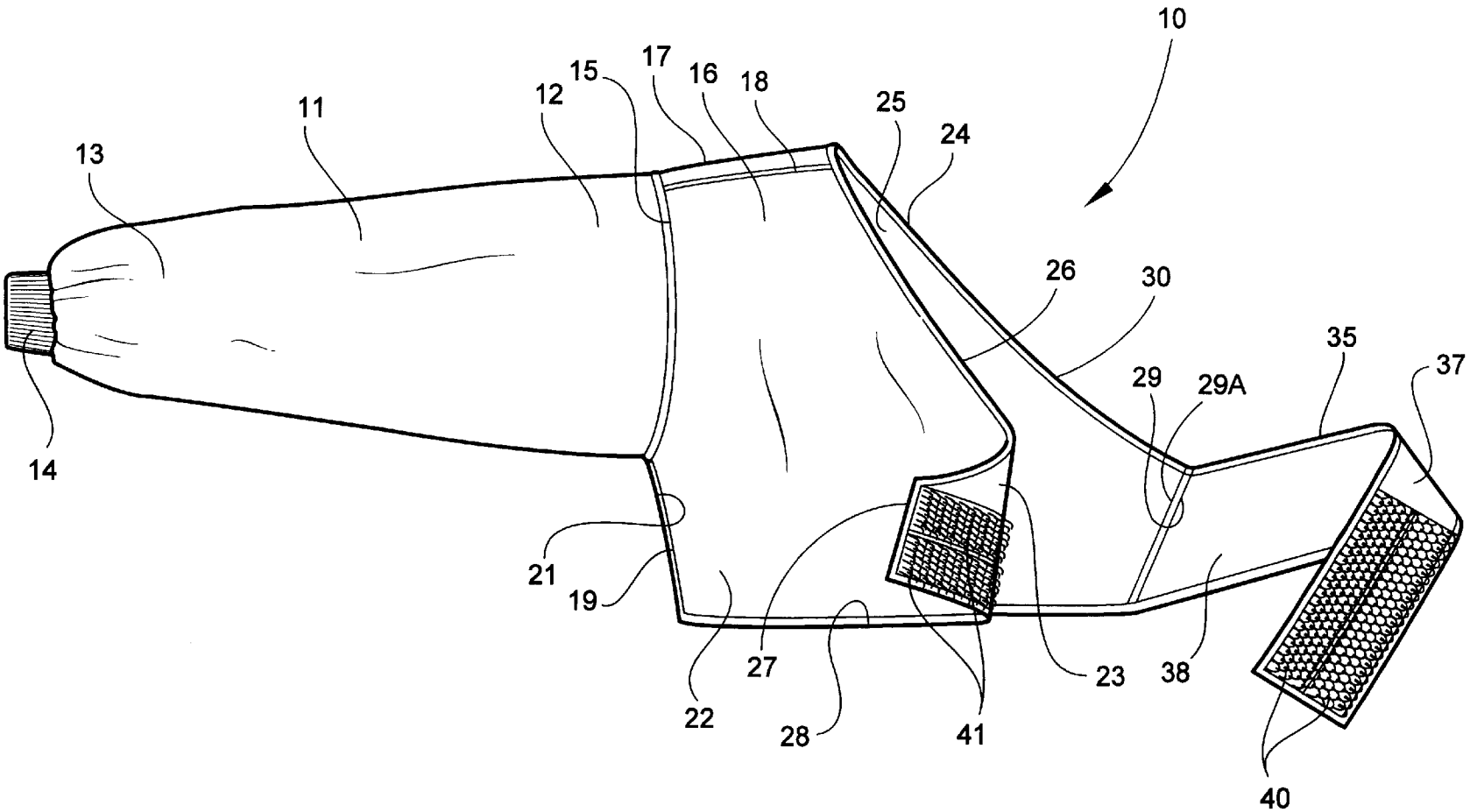
FIG. 6 is a perspective view of a warmup garment according to another embodiment of the present invention with the attachment panel shown in an open position.

The garment 10 shown in FIGS. 1–5 is adapted to fit the left arm and shoulder of an athlete; however, as is shown in FIG. 6, the garment 10 may alternatively be adapted to fit an athlete's right arm and shoulder.

Figure 7:
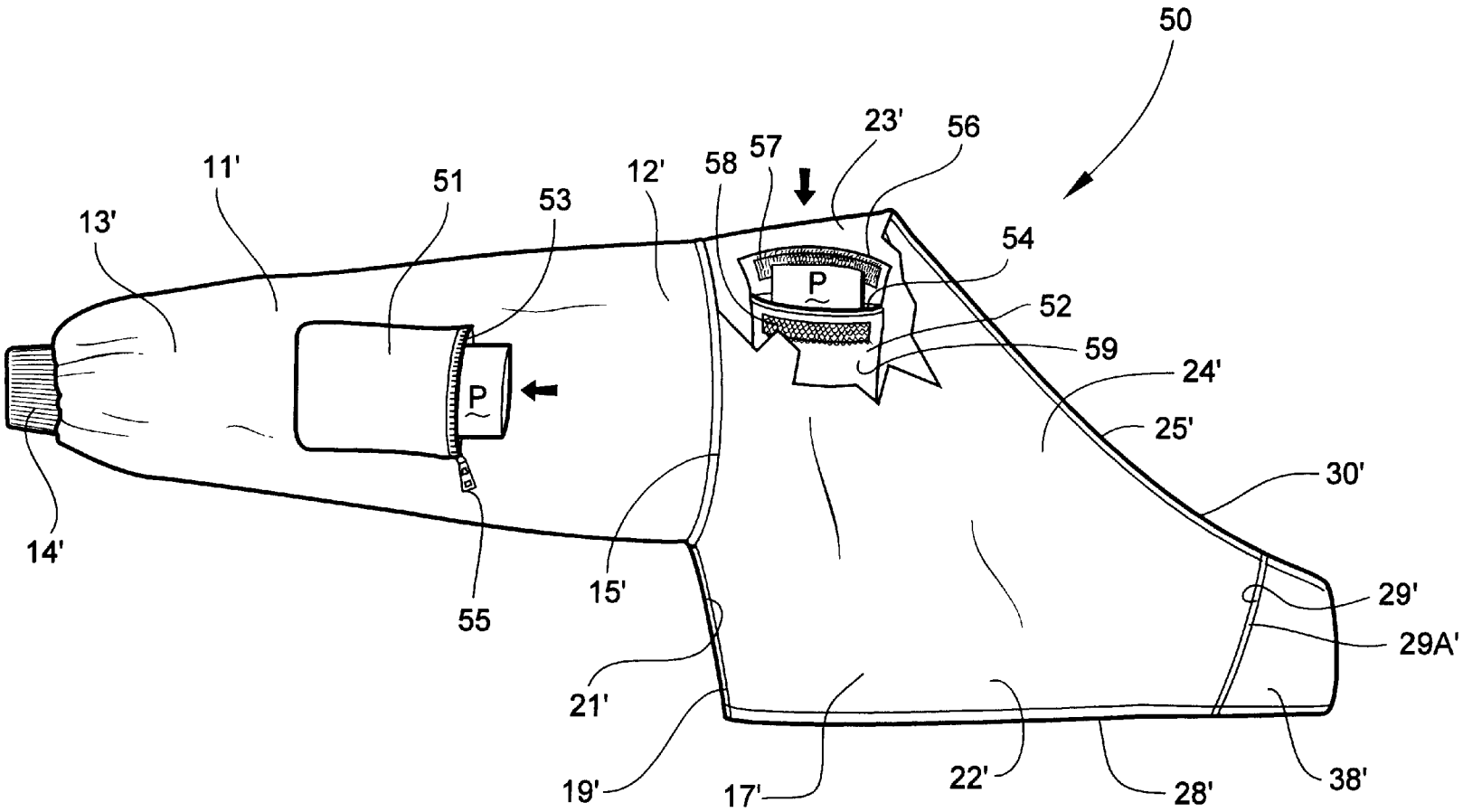
FIG. 7 is a cut-away perspective view of the back of a warmup garment according to another preferred embodiment of the invention.
Figure 8:
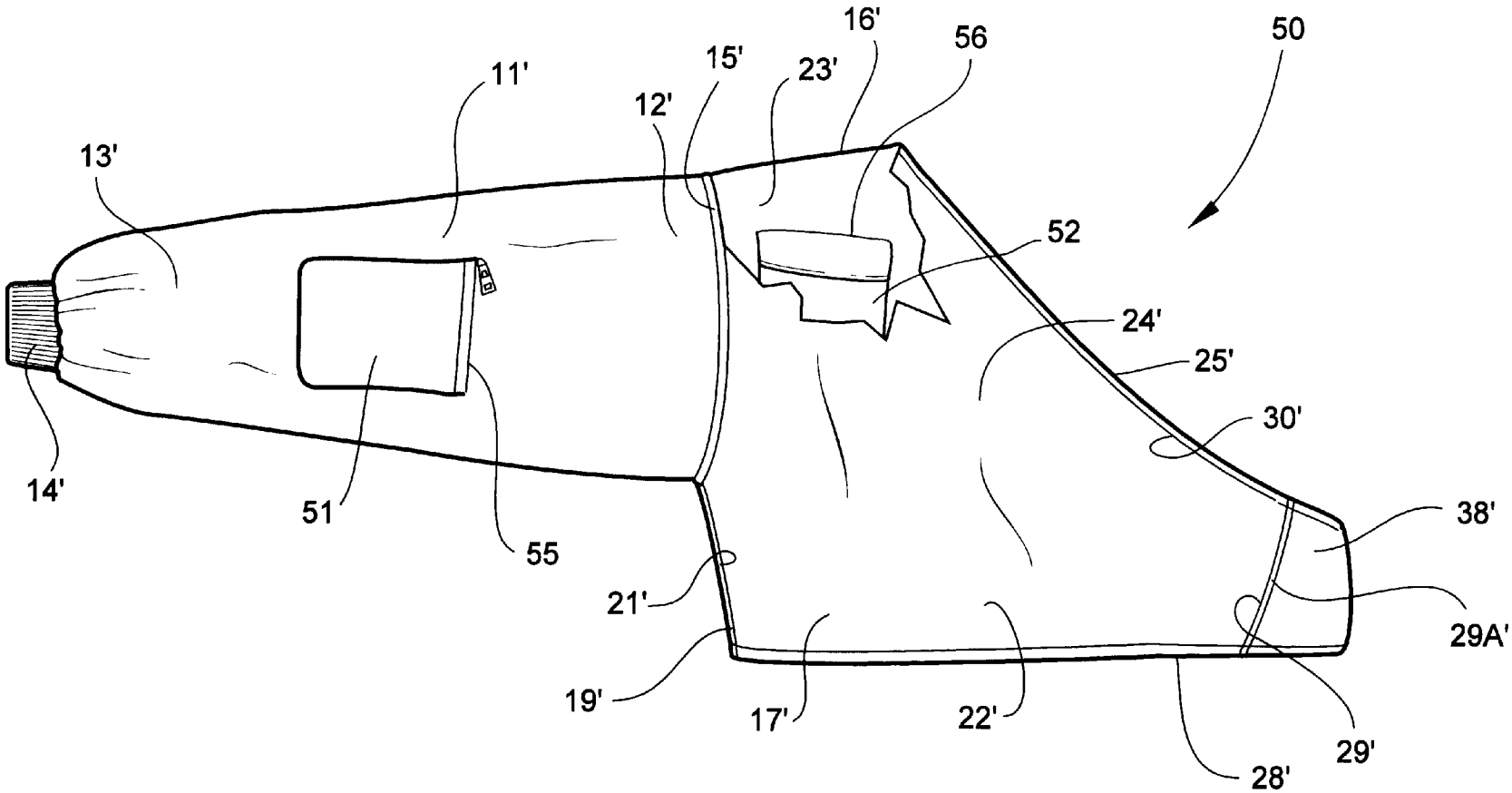
FIG. 8 is a cut-away perspective view of the warmup garment shown in FIG. 7.

Referring now to FIGS. 7 and 8, a warmup garment according to another embodiment of the present invention is shown generally at reference numeral 50. With the exception of the pockets, which are discussed in detail below, the components of the garment 50 are the same as those of the garment 10 shown in FIGS. 1 through 5. Like elements are thus shown in FIGS. 7 and 8 using prime reference numerals. As is shown in FIG. 7, the garment 50 includes an elbow pocket 51 and a shoulder pocket 52, which define respective openings 53 and 54 into which individual, therapeutic hot or cold packs "P" are inserted. The elbow pocket 51 includes a zipper 55 which is shown in an open position for permitting the therapeutic pack "P" to be inserted into the pocket 51. Pocket 52 includes a closure flap 56 which is likewise shown in FIG. 6 in an open position. A strip of male or female hook-and-loop fasteners 57 are attached to closure flap 56 and cooperate with a complementary strip of male or female hook-and-loop fasteners 58 for opening and closing pocket 52. Fastener strip 58 is attached to an outer surface 59 of pocket 52. As shown in FIG. 8, once the packs "P" are positioned inside the pockets 51 and 52, and the respective zipper 55 and closure flap 56 are closed, the packs "P" are prevented from becoming dislodged or otherwise shifting while the garment 50 is being worn.

Although FIGS. 7 and 8 show the elbow pocket 51 attached to the exterior of the sleeve 11' and the shoulder pocket 52 attached to the back face 23' of front panel 16', the pockets 51 and 52, along with any number of additional pockets, may be attached to the interior or exterior of the garment 50 at any locations where therapeutic warming, cooling, or pain relief is needed. Furthermore, each pocket 51 or 52 may be attached to the garment 50 using adhesives, by sewing, or by using other suitable attachment means. Furthermore, although the garment 50 shown in FIGS. 7 and 8 is adapted to fit the left arm and shoulder of an athlete, in an alternative embodiment of the invention, the garment 50 is adapted to fit the right arm and shoulder of an athlete.

A warm-up garment for maintaining warmth in a single arm and shoulder area of a wearer has been disclosed. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A warm-up garment for maintaining warmth in a single arm and shoulder area of a wearer, comprising:

(a) a single sleeve having an upper end with an opening for receiving the wearer's hand and arm therethrough, and a lower end having a lower opening for receiving the wearer's hand therethrough;

(b) a body portion attached to said sleeve adjacent said upper end opening and comprising front and back panels joined across a top and a side edge adjacent the sleeve and extending diagonally across the torso of the wearer from the upper end of the sleeve to an area under the wearer's arm opposite the sleeve; and (c) an attachment panel having a first end attached to the back panel and a second end adapted for being extended from the back panel around said area under the wearer's arm opposite the sleeve to the front panel and for releasably securing the front and back panels around the body of the wearer without encircling the neck of the wearer.

2. A warm-up garment according to claim 1, wherein said lower end of the sleeve includes a cuff adapted for fitting closely against the wearer's wrist.

3. A warm-up garment according to claim 2, wherein said front panel includes a first oblique edge extending diagonally from said top edge across the chest of the wearer and a front bottom edge extending across the upper torso adjacent the rib cage of the wearer.

4. A warm-up garment according to claim 3, wherein said back panel includes a second oblique edge extending from said top edge diagonally across the spinal column of the wearer and a back bottom edge extending between said side edge adjacent the sleeve and said second edge of the attachment panel.

5. A warm-up garment according to claim 4, wherein said front panel further includes inner and outer faces, said inner face adapted for releasably securing an outer surface of the second end of the attachment panel thereto.

6. A warm-up garment according to claim 5, and including complementary fasteners attached to said outer surface of the attachment panel and to the inner face of the front panel for releasably securing the inner face to the outer surface.

7. A warm-up garment according to claim 6, wherein said complementary fasteners are attached to the outer surface of the second end of the attachment panel and the inner face of the front panel adjacent the front bottom edge.

8. A warm-up garment according to claim 7, wherein said complementary fasteners comprise strips of hook-and-loop material.

9. A warm-up garment according to claim 8, and further comprising at least one pocket attached to the sleeve and adapted for receiving a therapeutic pack therein.

* * * * *